US009229403B2

(12) United States Patent
Matsui

(10) Patent No.: US 9,229,403 B2
(45) Date of Patent: Jan. 5, 2016

(54) RECORDING MATERIAL IMAGE CAPTURE DEVICE AND IMAGE FORMING APPARATUS

(71) Applicant: CANON KABUSHIKI KAISHA, Tokyo (JP)

(72) Inventor: Norio Matsui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 14/087,218

(22) Filed: Nov. 22, 2013

(65) Prior Publication Data

US 2014/0161475 A1 Jun. 12, 2014

(30) Foreign Application Priority Data

Dec. 11, 2012 (JP) ..... 2012-270253

(51) Int. Cl.

*G03G 15/00* (2006.01)
*B65H 5/06* (2006.01)
*G03G 15/20* (2006.01)

(52) U.S. Cl.

CPC ..... *G03G 15/5029* (2013.01); *B65H 5/068* (2013.01); *B65H 2404/13163* (2013.01); *G03G 15/2039* (2013.01); *G03G 2215/00734* (2013.01); *G03G 2215/00751* (2013.01)

(58) Field of Classification Search

CPC ..... G03G 2215/00751; G03G 15/5029; B65H 5/068; B65H 2404/1316; B65H 2404/13163; B65H 2404/132; B65H 2404/1321; B65H 2404/1121

USPC ..... 399/45

See application file for complete search history.

(56) References Cited

U.S. PATENT DOCUMENTS

| | | | | |
|---|---|---|---|---|
| 5,893,821 | A * | 4/1999 | Ando et al. | 492/59 |
| 8,582,116 | B2 | 11/2013 | Ebihara et al. | |
| 8,861,999 | B2 * | 10/2014 | Ishida et al. | 399/45 |
| 2010/0259772 | A1 * | 10/2010 | Ebihara et al. | 358/1.9 |
| 2012/0106994 | A1 | 5/2012 | Ishida et al. | |
| 2012/0148275 | A1 * | 6/2012 | Matsui et al. | 399/45 |
| 2014/0037351 | A1 * | 2/2014 | Matsui et al. | 399/389 |

FOREIGN PATENT DOCUMENTS

| | | | |
|---|---|---|---|
| JP | 4447975 | B2 | 4/2010 |
| JP | 2010-266432 | A | 11/2010 |
| JP | 2012-106481 | A | 6/2012 |
| JP | 2012-173415 | A | 9/2012 |

* cited by examiner

*Primary Examiner* — Christopher Mahoney
(74) *Attorney, Agent, or Firm* — Fitzpatrick, Cella, Harper & Scinto

(57) ABSTRACT

A recording material image capture device includes light sources radiating light to a recording material, an image capture element receiving the light which is reflected on a surface of the recording material, a cover member provided between the image capture element and the recording material so that the reflected light passes through the cover member, a roller pressing the recording material toward the cover member, and an output portion outputting, based on an image captured by the image capture element, a value related to the recording material to which the light is radiated. The roller is a rotating member which rotates along with movement of the recording material, and the roller includes a recess portion which is prevented from contacting with an entire portion corresponding to the image used for determining the recording material, and projecting portions which are brought into contact with the recording material.

19 Claims, 15 Drawing Sheets

RECORDING MATERIAL IMAGE CAPTURE DEVICE AND IMAGE FORMING APPARATUS

BACKGROUND OF THE INVENTION

1. Field of the Invention

The present invention relates to a recording material image capture device for capturing an image (taking an image) of a surface of a recording material, and to an image forming apparatus.

2. Description of the Related Art

An electrophotographic image forming apparatus such as a copying machine and a laser printer includes an image bearing member for bearing a latent image, a developing device for visualizing the latent image as a developer image by applying a developer to the image bearing member, a transfer unit for transferring the developer image, which is formed by the developing device, onto a recording material conveyed in a predetermined direction under predetermined transfer conditions, and a fixing device for fixing the developer image onto the recording material by heating and pressurizing, under predetermined fixing conditions, the recording material onto which the developer image is transferred by the transfer unit.

Conventionally, in such an image forming apparatus, the size and the type of the recording material are set by a user through a control panel or the like of the image forming apparatus. The image forming apparatus is controlled so that the transfer conditions (for example, the transfer bias voltage or the speed of conveying the recording material in transfer) or the fixing conditions (for example, the fixing temperature or the speed of conveying the recording material in fixing) are set in accordance with the settings.

In recent years, there has also been proposed an image forming apparatus which determines the type of the recording material using a sensor for determining the recording material in the image forming apparatus and controls to set the transfer conditions or the fixing conditions in accordance with the result of the determination.

For example, Japanese Patent Application Laid-Open No. 2010-266432 describes determination of the smoothness of a surface of a recording material with high accuracy by radiating light at a relatively small angle (about 10 to 15 degrees) with respect to the surface of the recording material to be detected, producing a shadow due to unevenness on the surface of the recording material, and capturing an image of the shadow.

Japanese Patent No. 4,447,975 describes suppression of flaps of a recording material by providing an urging plate opposed to a detecting portion of an optical sensor and pressing, with the urging plate, the recording material against the detecting portion of the optical sensor when the recording material to be detected is conveyed.

In Japanese Patent Application Laid-Open No. 2010-266432, light is radiated at a relatively small angle (about 10 to 15 degrees) with respect to the surface of the recording material and a shadow is produced due to unevenness on the surface of the recording material. When an image of the shadow is captured, during the period in which the recording material to be detected is conveyed, the vertical positional variations (flaps) of the recording material are generated to the extent higher than assumed. In such a case, if the property of the surface of the recording material cannot be optically captured with high accuracy, the accuracy of determining the recording material is reduced.

Therefore, as in Japanese Patent No. 4,447,975, the flaps may be suppressed by providing a light transmissive member which passes through light to the side of a sensor for capturing an image of the surface of the recording material and pressing, with the urging plate, the recording material against the light transmissive member. However, depending on the pressing force of the urging plate and the type of the recording material, the light transmissive member is repeatedly rubbed against the conveyed recording material and thus is damaged.

In this case, the sensor for capturing an image of the surface of the recording material receives light which passes through the damaged light transmissive member, and irregular reflection components are increased by the damage. Therefore, there is a problem in that an image of a shadow on the surface of the recording material cannot be captured with high accuracy.

SUMMARY OF THE INVENTION

The present invention provides a recording material image capture device and an image forming apparatus which suppress flaps of a recording material and, at the same time, suppress damage to a light transmissive member. According to one embodiment of the present invention, there is provided a recording material image capture device, including: a light radiating unit radiating light to a recording material; an image capture unit receiving the light which is radiated from the light radiating unit and is reflected on a surface of the recording material; a light transmissive member provided between the image capture unit and the recording material to which the light is radiated from the light radiating unit so that the light reflected on the surface of the recording material passes through the light transmissive member; a pressing member provided so as to be opposed to the light transmissive member, pressing the recording material toward the light transmissive member, and rotating along with movement of the recording material which is conveyed on the light transmissive member; an output portion outputting, based on an image captured by the image capture unit, a value related to the recording material to which the light is radiated from the light radiating unit; and the pressing member having a non-contact region which is prevented from contacting with an entire portion corresponding to the image used for determining the recording material, and a contact region which is brought into contact with the recording material.

Further, according to another embodiment of the present invention, there is provided an image forming apparatus, including: a light radiating unit radiating light to a recording material; an image capture unit receiving the light which is radiated from the light radiating unit and is reflected on a surface of the recording material; a light transmissive member provided between the image capture unit and the recording material to which the light is radiated from the light radiating unit so that the light reflected on the surface of the recording material passes through the light transmissive member; a pressing member provided so as to be opposed to the light transmissive member, pressing the recording material toward the light transmissive member, and rotating along with movement of the recording material which is conveyed on the light transmissive member; an output portion outputting, based on an image captured by the image capture unit, a value related to the recording material to which the light is radiated from the light radiating unit; an image forming unit forming a toner image on the recording material, the image forming unit determining image forming conditions based on the output from the output portion; and the pressing member having a non-contact region which is prevented from contacting with an entire portion corresponding to the image used for determining the recording material, and a contact region which is brought into contact with the recording material.

Further, according to another embodiment of the present invention, there is provided a recording material image capture device, including: a light radiating unit radiating light to a recording material; an image capture unit receiving the light which is radiated from the light radiating unit and is reflected on a surface of the recording material; a light transmissive member provided between the image capture unit and the recording material to which the light is radiated from the light radiating unit so that the light reflected on the surface of the recording material passes through the light transmissive member; a pressing member provided so as to be opposed to the light transmissive member, pressing the recording material toward the light transmissive member, and rotating along with movement of the recording material which is conveyed on the light transmissive member; an output portion outputting, based on an image captured by the image capture unit, a value related to the recording material to which the light is radiated from the light radiating unit; and the pressing member having a hard portion and a soft portion, the hard portion being brought into contact with a portion of the recording material other than a portion corresponding to the image used for determining the recording material, the soft portion being brought into elastic contact with the portion of the recording material corresponding to the image used for determining the recording material.

Further, according to another embodiment of the present invention, there is provided an image forming apparatus, including: a light radiating unit radiating light to a recording material; an image capture unit receiving the light which is radiated from the light radiating unit and is reflected on a surface of the recording material; a light transmissive member provided between the image capture unit and the recording material to which the light is radiated from the light radiating unit so that the light reflected on the surface of the recording material passes through the light transmissive member; a pressing member provided so as to be opposed to the light transmissive member, pressing the recording material toward the light transmissive member, and rotating along with movement of the recording material which is conveyed on the light transmissive member; an output portion outputting, based on an image captured by the image capture unit, a value related to the recording material to which the light is radiated from the light radiating unit; an image forming unit forming a toner image on the recording material, the image forming unit determining image forming conditions based on the output from the output portion; and the pressing member having a hard portion and a soft portion, the hard portion being brought into contact with a portion of the recording material other than a portion corresponding to the image used for determining the recording material, the soft portion being brought into elastic contact with the portion of the recording material corresponding to the image used for determining the recording material.

Further features of the present invention will become apparent from the following description of exemplary embodiments with reference to the attached drawings.

DESCRIPTION OF THE EMBODIMENTS

A recording material determining device (recording material image capture device) and an image forming apparatus including the recording material determining device according to embodiments of the present invention are described in detail with reference to the attached drawings.

(First Embodiment)

First, structures of a recording material determining device (recording material image capture device) according to a first embodiment of the present invention and an image forming apparatus including the recording material determining device according to the first embodiment are described with reference to FIG. 1 to FIG. 12C.

Figure 1:
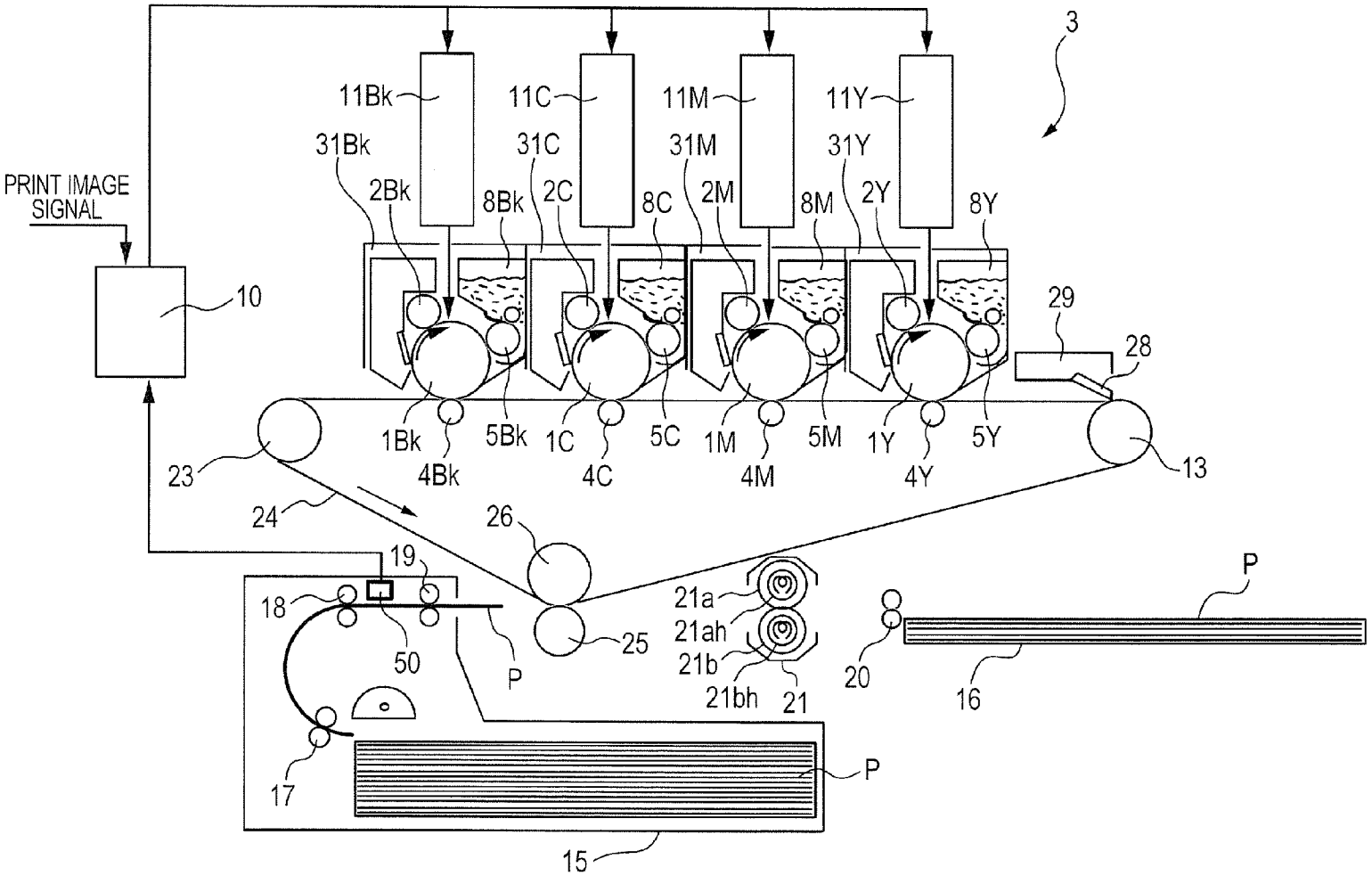
FIG. 1 is an explanatory sectional view illustrating a structure of an image forming apparatus which includes a recording material determining device according to embodiments of the present invention.

A recording material determining device (recording material image capture device) 50 according to this embodiment can be used for, for example, an electrophotographic color image forming apparatus 3. FIG. 1 illustrates, as an example thereof, a tandem color image forming apparatus 3 which adopts an intermediate transfer belt 24.

<Image Forming Apparatus>

First, a structure and operation of an image forming portion of the image forming apparatus 3 which is used in this embodiment are described with reference to FIG. 1.

The image forming portion as an image forming unit for forming a toner image on a recording material P includes a feed cassette 15 serving as a feeding portion and photosensitive drums 1Y, 1M, 1C, and 1Bk serving as image bearing members on which toner images of yellow (Y), magenta (M), cyan (C), and black (Bk) stations are formed, respectively.

The image forming apparatus 3 further includes charging rollers 2Y, 2M, 2C, and 2Bk as primary charging units, exposure light scanner portions 11Y, 11M, 11C, and 11Bk, developing devices 8Y, 8M, 8C, and 8Bk as developing units, the intermediate transfer belt 24 serving as an image bearing member on which a toner image is formed, a driving roller 23 for driving the intermediate transfer belt 24, a stretching roller 13, and a secondary transfer opposing roller 26.

The image forming apparatus 3 further includes primary transfer rollers 4Y, 4M, 4C, and 4Bk, a secondary transfer roller 25 serving as a transfer unit for transferring, onto the recording material P, a toner image formed on the intermediate transfer belt 24, a fixing portion 21 serving as an image fixing unit for fixing, by heating and pressurizing the recording material P, a toner image formed on the recording material P (on the recording material), and a control portion 10 serving as a control unit for controlling the above-mentioned components.

For the sake of convenience of description, the description is sometimes made with regard to photosensitive drums 1 which represent the photosensitive drums 1Y, 1M, 1C, and 1Bk. Other image forming units are described in similar ways.

The photosensitive drums 1Y, 1M, 1C, and 1Bk are respectively formed by applying an organic photoconductive layer on outer peripheries of cylinders made of aluminum, and are rotated by driving force transferred from a driving motor (not shown). The driving motor rotates the photosensitive drums 1Y, 1M, 1C, and 1Bk in a clockwise direction in FIG. 1 in accordance with image forming operation.

When the control portion 10 receives an image signal, the recording material P is fed from the feed cassette 15 or the like by feed rollers 17 and 18 into the image forming apparatus 3. The recording material P is then temporarily nipped between registration rollers 19 serving as roller-like synchronous rotation members for synchronization between the image forming operation and the conveyance of the recording material P, and is stopped to wait.

In accordance with the received image signal, the control portion 10 forms electrostatic latent images with the exposure light scanner portions 11Y, 11M, 11C, and 11Bk on surfaces of the photosensitive drums 1Y, 1M, 1C, and 1Bk which are charged at a predetermined potential by the action of the charging rollers 2Y, 2M, 2C, and 2Bk, respectively.

The developing devices 8Y, 8M, 8C, and 8Bk are units for visualizing, as toner images, the electrostatic latent images formed on the surfaces of the photosensitive drums 1 by supplying toner thereto, and develop images of yellow Y, magenta M, cyan C, and black Bk of the respective stations. The developing devices 8 are provided with developing sleeves 5Y, 5M, 5C, and 5Bk, respectively, and developing bias voltage for visualizing the electrostatic latent images is applied to the developing sleeves 5.

The electrostatic latent images formed on the surfaces of the photosensitive drums 1Y, 1M, 1C, and 1Bk are developed as single color toner images by the action of the developing devices 8Y, 8M, 8C, and 8Bk, respectively.

The photosensitive drum 1, the charging roller 2, and the developing device 8 are integrally formed, and are mounted to a main body of the image forming apparatus 3 in the form of a toner cartridge 31 which is removable therefrom.

The intermediate transfer belt 24 is separately held in contact with the surfaces of the photosensitive drums 1Y, 1M, 1C, and 1Bk, and, when a color image is formed, rotates in the counterclockwise direction in FIG. 1 in synchronization with rotations of the photosensitive drums 1Y, 1M, 1C, and 1Bk. The single color toner images developed on the surfaces of the photosensitive drums 1 are transferred in sequence onto the outer peripheral surface of the intermediate transfer belt 24 by the action of primary transfer bias voltage applied to the primary transfer rollers 4, and a multicolored toner image is formed on the intermediate transfer belt 24.

After that, the multicolored toner image formed on the intermediate transfer belt 24 is conveyed into a secondary transfer nip portion formed by the secondary transfer roller 25 and the intermediate transfer belt 24. At the same time, the recording material P which has been waiting under a state of being nipped between the registration rollers 19 is conveyed into the secondary transfer nip portion by the action of the registration rollers 19 in synchronization with the multicolored toner image on the intermediate transfer belt 24. The multicolored toner image on the intermediate transfer belt 24 is collectively transferred onto the recording material P by the action of secondary transfer bias voltage applied to the secondary transfer roller 25.

The fixing portion 21 fuses and fixes the transferred multicolored toner image while conveying the recording material P, and, as illustrated in FIG. 1, includes a fixing roller 21*a* for heating the recording material P and a pressure roller 21*b* for pressing the recording material P so as to be held in contact with the fixing roller 21*a*.

The fixing roller 21*a* and the pressure roller 21*b* are formed into a hollow shape, and include therein heaters 21*ah* and 21*bh*, respectively.

The recording material P having the multicolored toner image is conveyed by the fixing roller 21*a* and pressure roller 21*b*, and heat and pressure are applied thereto to fix the toner on a surface of the recording material P The recording material P after the toner image is fixed thereon is discharged by delivery rollers 20 onto a delivery tray 16, and the image forming operation ends.

A cleaning blade 28 serving as a cleaning unit removes transfer residual toner which remains on the intermediate transfer belt 24. The transfer residual toner is collected and accumulated in a waste toner container 29 as waste toner.

This series of image forming operations is controlled by the control portion 10 provided in the image forming apparatus 3.

In the image forming apparatus 3 illustrated in FIG. 1, the recording material determining device 50 of this embodiment is arranged in a recording material determining portion provided in the vicinity of the registration rollers 19 on its downstream side on a recording material conveyance path. Information which reflects the surface smoothness of the recording material P fed from the feed cassette 15 is detected by the recording material determining device 50. In this embodiment, determination of the surface smoothness of the recording material P by the recording material determining device 50 is made while the recording material P is fed from the feed cassette 15 into the image forming apparatus 3 and is nipped between and conveyed by the registration rollers 19.

The control portion 10 determines the optimum image forming conditions of the image forming unit based on the determination information (result of determination) of the recording material P which is sent from the recording material determining device 50, and controls to operate the image forming apparatus 3. Further, the control portion 10 determines the optimum transfer bias voltage to be the transfer conditions of the secondary transfer roller 25 serving as the transfer unit and controls to operate the image forming apparatus 3. Still further, the control portion 10 determines the optimum fixing temperature and the like to be the fixing conditions of the fixing portion 21 serving as the fixing unit and controls to operate the image forming apparatus 3.

<Recording Material Determining Device>

Next, a structure of the recording material determining device 50 of this embodiment is described. Note that, the recording material determining device 50 is a recording material image capture device which captures (takes) an image of a surface of a recording material for the purpose of determining the surface property of the recording material.

<Comparative Example and Problem Thereof>

Figure 2:
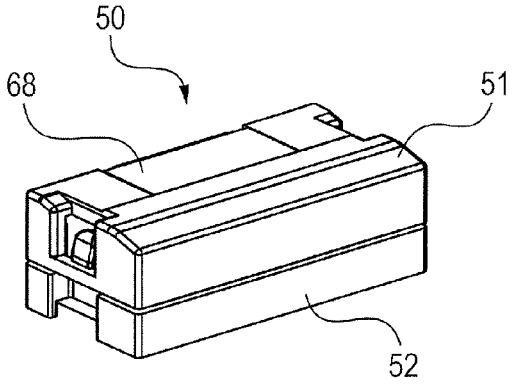
FIG. 2 is an explanatory perspective view illustrating a structure of an optical system of the recording material determining device.

A structure of a comparative example and a problem thereof are described with reference to FIG. 2 to FIG. 8B. FIG. 2 is a perspective view of the entire recording material determining device 50 alone. The recording material determining device 50 includes an upper lid member 51 and a housing member 52.

Figure 3:
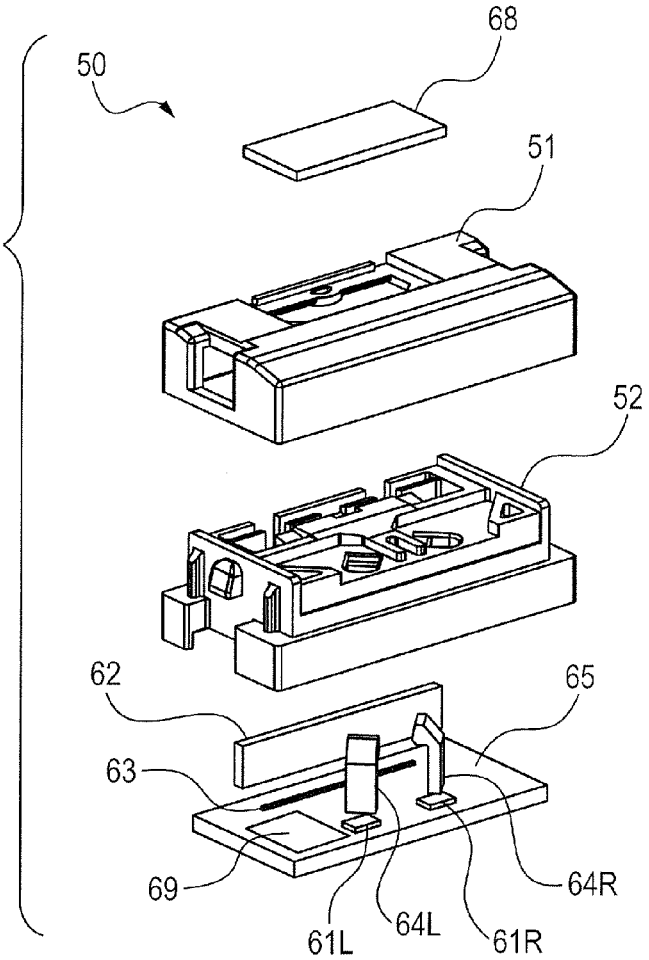
FIG. 3 is an exploded perspective view illustrating the structure of the optical system of the recording material determining device.

FIG. 3 is an exploded perspective view of the recording material determining device 50. As illustrated in FIG. 3, two light sources 61R and 61L mounted on a base plate 65, which is provided below the housing member 52, as a light radiating unit for radiating light to the recording material P from different directions radiate light toward the recording material P illustrated in FIG. 5B. The light sources 61R and 61L of this embodiment include chip mounted light emitting diodes (LEDs).

Figure 4A:
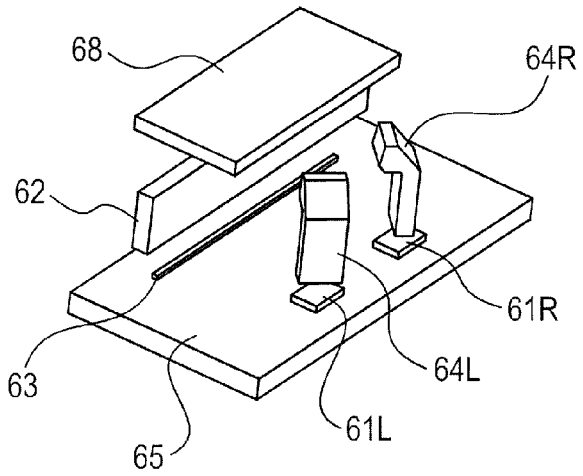
FIG. 4A is a perspective view illustrating an arrangement structure of optical components of the recording material determining device.
Figure 4B:
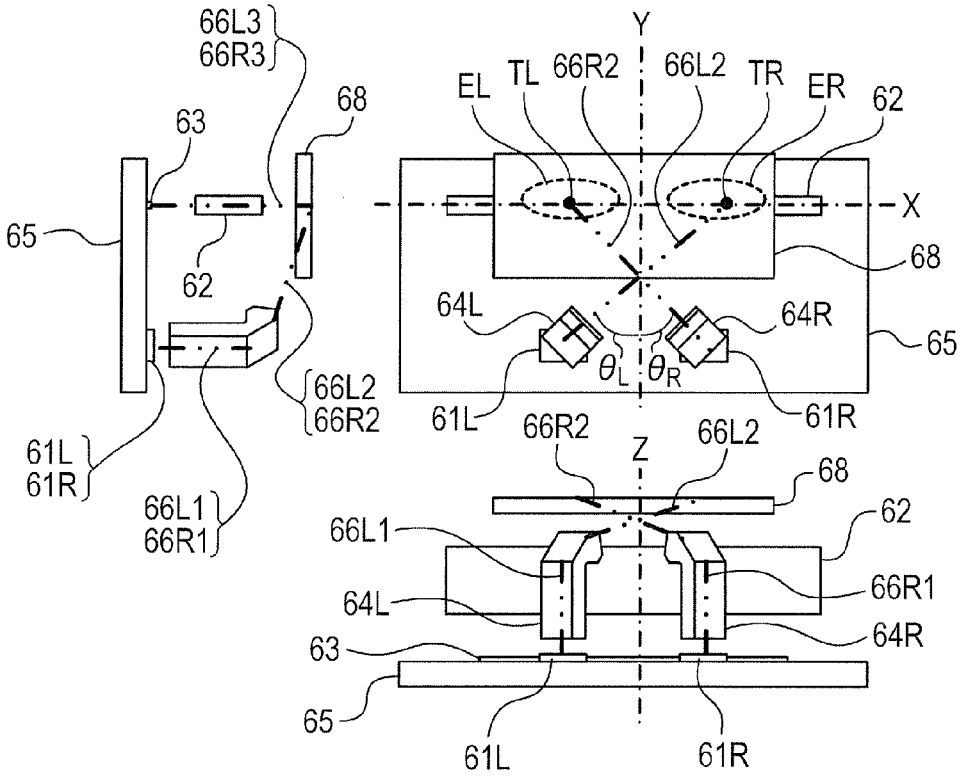
FIG. 4B is a plan view, a side view, and a front view illustrating the arrangement structure of the optical components of the recording material determining device.

In this case, as to the radiating directions of optical axes 66R1 and 66L1 radiated by the light sources 61R and 61L, as illustrated in FIG. 4B, their optical paths are deflected as optical axes 66R2 and 66L2 by deflectors 64R and 64L in the recording material determining device 50. The light passes through a cover member 68 which is mounted on the upper lid member 51 and serves as a transparent light transmissive member formed of glass or the like that supports the recording material P and guides the conveyance and also prevents entry of dust from the outside. Then, the light is guided to the surface of the recording material P illustrated in FIG. 5B.

The cover member 68 serving as a light transmissive member is provided between the recording material P to which light is radiated by the light sources 61R and 61L and a linear image capture element 63 serving as an image capture unit for receiving light reflected on the surface of the recording material P (surface of the recording material), and light reflected on the surface of the recording material P (surface of the recording material) passes therethrough.

The optical axes 66R2 and 66L2 are guided and deflected by the deflectors 64R and 64L. Thereby, light is radiated to the surface of the recording material P through the transparent cover member 68. This enables detection of the property of the surface of the recording material P (unevenness due to paper fibers or the like of the recording material P) as the variations of light and dark (shadow). The linear image capture element 63, which includes a plurality of light receiving pixels mounted on the base plate 65 and arranged in a line, captures an image reflecting the property of the surface of the recording material P as the distribution of light and dark via a light collecting element 62 which is a rod lens.

Based on the obtained image which reflects the property of the surface of the recording material P, an optical feature value such as the contrast is extracted and calculated. Based on the value, the surface property of the recording material P can be determined (the type of the recording material P can be determined). The determination of the surface property of the recording material P specifically means that, based on the output from the image capture element 63, a determining portion (output portion) 69 provided on the base plate 65 extracts and calculates the above-mentioned optical feature value, and, based on the value, outputs a value related to the surface property of the recording material P subjected to the image capture operation to the control portion 10.

In this embodiment, as illustrated in FIG. 4B, in order that the property of the surface of the recording material P can be determined irrespective of the direction of orientation of the paper fibers of the recording material P, light is radiated from the two light sources 61R and 61L in two directions through the deflectors 64R and 64L, respectively, toward the surface of the recording material P.

FIG. 4A is a perspective view illustrating a three-dimensional arrangement structure of components of the recording material determining device 50 such as the light sources 61R and 61L and the deflectors 64R and 64L, with the upper lid member 51 and the housing member 52 being omitted for the sake of convenience of description. For the sake of convenience of description, the similar components which are provided symmetrically are sometimes described with the suffixes R and L being omitted.

FIG. 4B illustrates a state including optical paths and the like in a three-view drawing. Light beams 66L1, 66R1, 66L2, and 66R2 representing imaginary center lines of the optical paths of light which is guided from the light sources 61 to the deflectors 64 and passes through the cover member 68 to reach observation image centers T that are on the surface of the recording material P are indicated by two-dot chain lines, respectively.

The imaginary optical axis lines are illustrated with the observation image centers T being the optical centers. At the same time, effective radiation regions E on the surface of the recording material P (surface of the cover member 68) are indicated by oval broken lines in FIG. 4B. In this case, as illustrated in FIG. 4B, the optical axes 66R2 and 66L2 are at inclinations of θ from the conveyance direction of the recording material P (direction of the Y axis in FIG. 4B).

Further, imaginary optical axes 66R3 and 66L3 illustrated in FIG. 4B indicate a representative state of light which passes through the observation image centers T in the right and left effective radiation regions E on the cover member 68. An image of one line including the observation image center T in the effective radiation region E on the surface of the cover member (surface of the recording material P) is linearly captured through the light collecting element 62 by the linear image capture element 63.

Reference coordinates of arranging the respective components are described using the X axis, the Y axis, and the Z axis in FIG. 4B. The Y axis in FIG. 4B is an optical symmetry axis, and at the same time, indicates the conveyance direction of the recording material P. The X axis on the image capture element 63 indicates the direction orthogonal to the conveyance direction of the recording material P. The Z axis indicates the direction of thickness of the recording material P. When the recording material P is determined, in the image captured by the image capture element 63, portions in the image corresponding to the effective radiation regions ER and EL of the recording material P in the direction of the X axis are used.

Specifically, optical feature values such as the contrast for the portions in the image corresponding to the effective radiation regions ER and EL of the recording material P are extracted and calculated and, based on the values, the surface property of the recording material P is determined (the type of the recording material P is determined).

With respect to the recording material determining device 50 having such an optical system, it is desired that the recording material P is pressed against the surface of the cover member 68 so that the surface of the recording material P can be observed with high accuracy. By conveying the recording material P while pressing the recording material P against a flat portion of the surface of the cover member 68 with predetermined force, positional variations of the surface of the recording material P can be set within an allowable range of depth of the optical system.

Figure 5A:
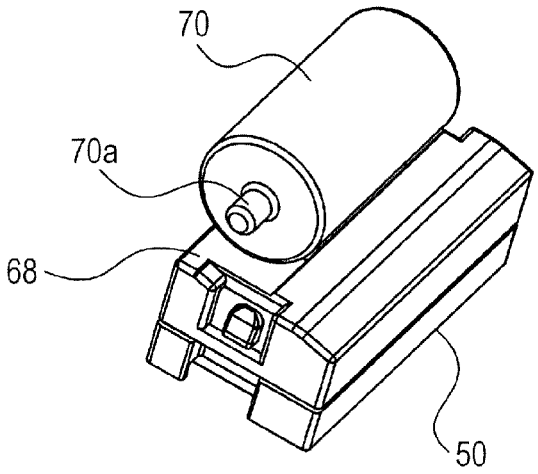
FIG. 5A is an explanatory perspective view illustrating a structure of a recording material determining device according to a comparative example.
Figure 5B:
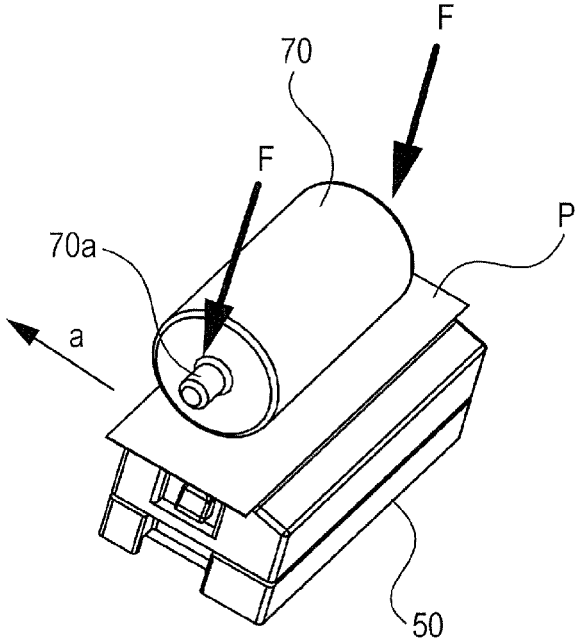
FIG. 5B is an explanatory perspective view illustrating a state in which a recording material is conveyed between a light transmissive member and a pressing member.

The above-mentioned state is described by way of a comparative example illustrated in FIGS. 5A and 5B. FIG. 5A illustrates a state in which a cylindrical roller 70 as a pressing member is mounted so as to be opposed to the cover member 68 provided on an upper surface of the recording material determining device 50. FIG. 5B illustrates a part of the recording material P, and illustrates a state in which the recording material P is conveyed while being nipped between the roller 70 and the cover member 68. The direction of the arrow a in FIG. 5B indicates the conveyance direction of the recording material P. The direction of the arrow F in FIG. 5B indicates the direction of the pressing force applied by the roller 70 which presses the recording material P toward the cover member 68.

Figure 6A:
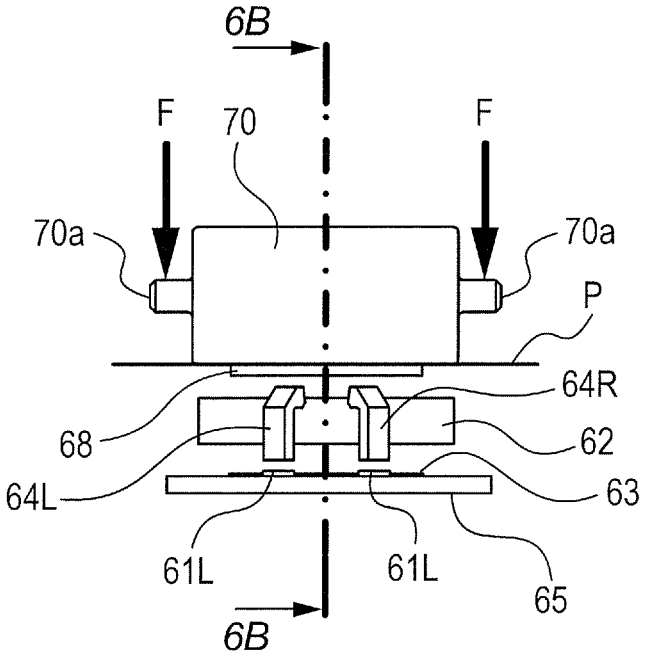
FIG. 6A is an explanatory front view illustrating a structure of a main part of the recording material determining device according to the comparative example.

FIG. 6A illustrates the direction F of the pressing force applied by the roller 70 that presses the recording material P toward the cover member 68, and the positional relationship between the cover member 68 and the recording material P as seen from the upstream side in the conveyance direction of the recording material P. As illustrated in FIG. 6A, the pressing force F is applied to both ends of a rotation shaft 70*a* of the roller 70 in the vertical direction (from the top in FIG. 6A) so that the recording material P is linearly nipped on the cover member 68.

Figure 6B:
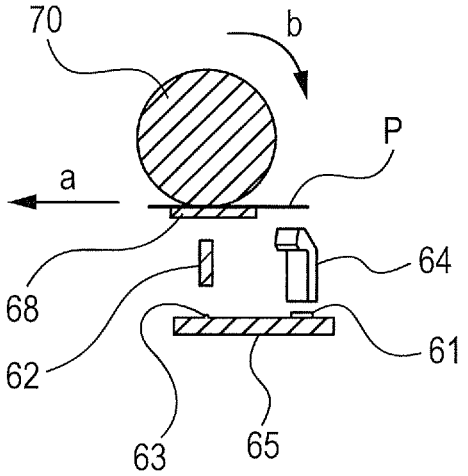
FIG. 6B is a sectional view taken along the line 6B-6B of FIG. 6A.

FIG. 6B is a sectional view taken along the line 6B-6B of FIG. 6A. In FIG. 6B, the conveyance direction of the recording material P is indicated by the arrow a, while the direction of rotation of the roller 70 is indicated by the arrow b. When the recording material P is conveyed and moved leftward in FIG. 6B, the roller 70 is driven to rotate in the direction of the arrow b while pressing the recording material P, and the recording material P moves on the cover member 68 while rubbing against the cover member 68.

Figure 7:
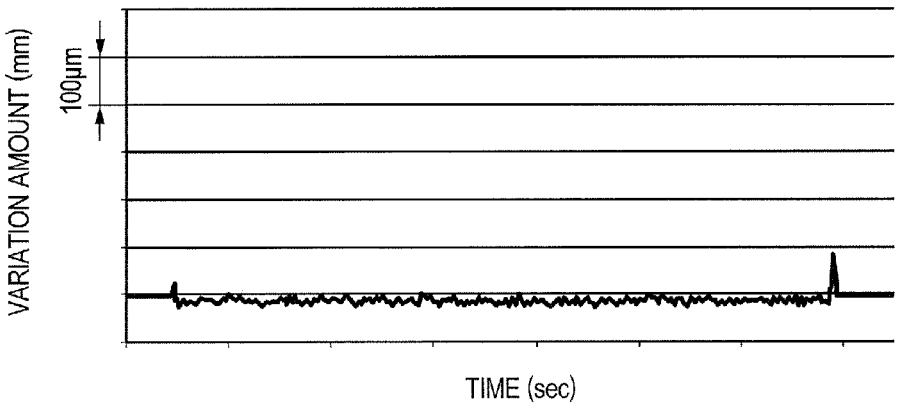
FIG. 7 illustrates a variation amount of the recording material when the recording material is conveyed in the recording material determining device according to the comparative example.

Such a structure enables reduction in the variation amount of the recording material P from the surface of the cover member 68 when the recording material P is conveyed. Exemplary results of measurement of the variation amount of the surface of the recording material P from the surface of the cover member 68 using a laser displacement meter are shown in FIG. 7. In FIG. 7, the horizontal axis indicates time (sec) while the vertical axis indicates variation amount (displacement in mm). The vertical axis is marked in 100 μm increments. As shown in FIG. 7, the variation amount (displacement) of the surface of the recording material P is equal to or smaller than the distance between adjacent markings of the vertical axis, that is, equal to or smaller than 100 μm.

Figure 8A:
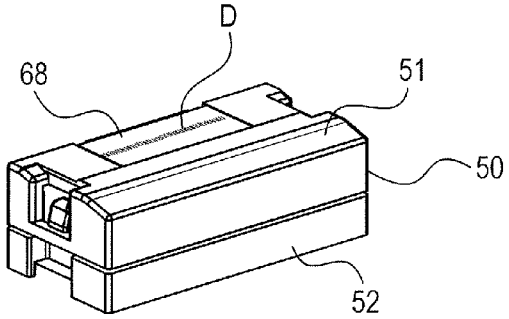
FIG. 8A is a perspective view illustrating a problem inherent in the recording material determining device according to the comparative example.
Figure 8B:
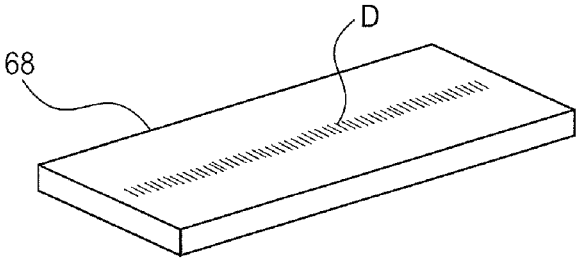
FIG. 8B is a perspective view illustrating a state in which a light transmissive member of the recording material determining device according to the comparative example is abraded.

However, when a large number of recording materials P of various types are conveyed using the roller 70 while pressing the recording materials P, the surfaces of the recording materials P and the cover member 68 are rubbed against each other. Therefore, as illustrated in FIGS. 8A and 8B, an abrasion D is caused on the surface of the cover member 68. FIG. 8A illustrates the entire recording material determining device 50 in which the abrasion D is caused on the surface of the cover member 68. FIG. 8B illustrates a structure of the cover member 68 alone in which the abrasion D is caused.

As illustrated in FIG. 8B, linear distribution of the abrasion D in a longitudinal direction (width direction) on the surface of the cover member 68 can be observed. Pressing the recording material P by the roller against the surface of the cover member 68 realizes reduction in the variation amount of the surface of the recording material P. However, with prolonged use, myriad fine scratches like the abrasion D are generated as a result on the surface of the cover member 68 along a nip portion formed by pressing the roller 70 against the cover member 68.

The surface of the recording material P is observed at the nip portion of the recording material P. When the property of the surface of the recording material P is determined, the abrasion D caused on the surface of the cover member 68 induces irregular reflection components for the optical observation system, and the amount of light is reduced and noise components due to the optical factor are caused. Therefore, it becomes difficult to obtain expected observation data of the surface of the recording material P, and there arises a problem in that the accuracy of determining the recording material P is reduced.

A simple way to solve this problem is thought to be reduction of the pressing force F applied by the roller 70, because the abrasion D is thought to be less liable to be caused. However, the variation amount of the recording material P becomes less liable to be controlled.

In order that the nip point on the roller 70 which is pressed by the roller 70 as a factor of causing the abrasion D is prevented from being coincident with the detection point by the optical system, the nip point formed by the roller 70 may be shifted upstream or downstream in the conveyance direction of the recording material P. However, the length of the abrasion D in the conveyance direction of the recording material P is several millimeters or more, and thus, it is necessary to effect the shift by a distance of several millimeters or more from the detection point by the optical system. If such a structure is adopted, the pressing and restraining force for the recording material P is inevitably reduced, and it becomes difficult to observe the surface of the recording material P with stability.

In order to solve the problem of the comparative example illustrated in FIG. 5A to FIG. 8B, this embodiment has the following structure.

Figure 9A:
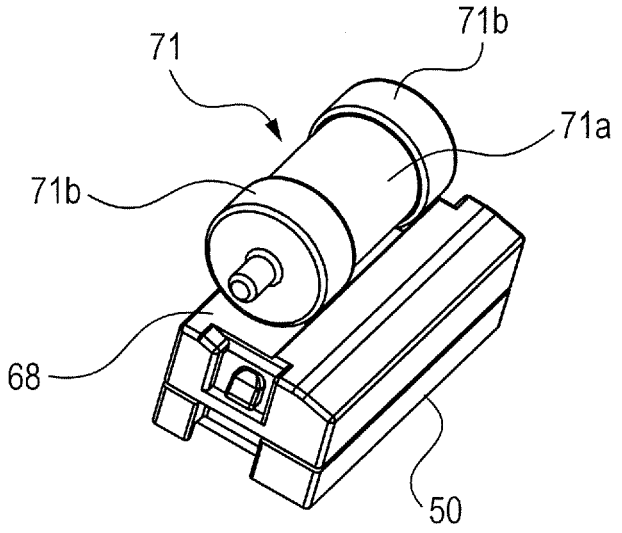
FIG. 9A is an explanatory perspective view illustrating a structure of a recording material determining device according to a first embodiment of the present invention.

In FIG. 9A, as the pressing member opposed to the cover member 68 that is the light transmissive member of the recording material determining device 50, for pressing the recording material P toward the cover member 68, a roller 71 serving as a rotating member which rotates along with movement of the recording material P that is conveyed on the cover member 68 (on the light transmissive member) is provided.

Based on an image captured by the image capture element 63, the recording material determining device 50 determines the type of the recording material P to which light is radiated from the light sources 61. A recess portion 71*a* serving as a non-contact region, which is not brought into contact with the entire portion corresponding to the image used for determining the recording material P, is provided in a center portion in an axial direction of a cylindrical portion of the roller 71. Projecting portions 71*b* serving as contact regions, which are brought into contact with the recording material P, are provided on both sides of the recess portion 71*a* serving as the non-contact region of the roller 71 in a direction orthogonal to the conveyance direction of the recording material P.

Figure 9B:
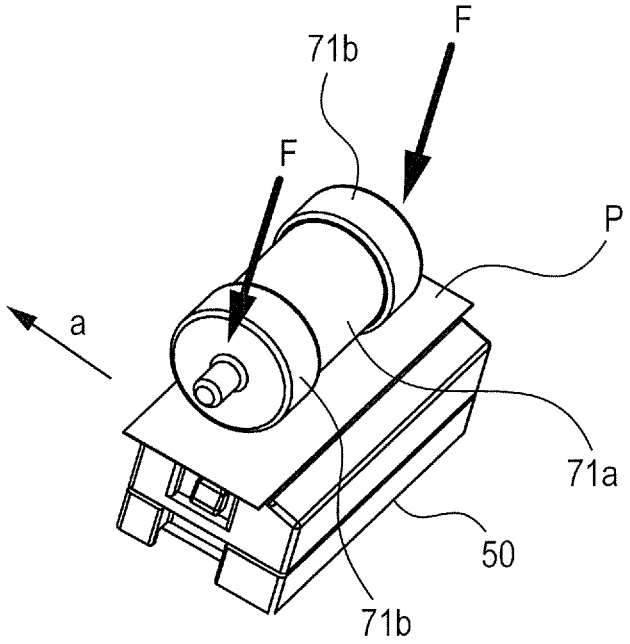
FIG. 9B is an explanatory perspective view illustrating a state in which a recording material is conveyed between a light transmissive member and a pressing member of the recording material determining device according to the first embodiment.
Figure 10A:
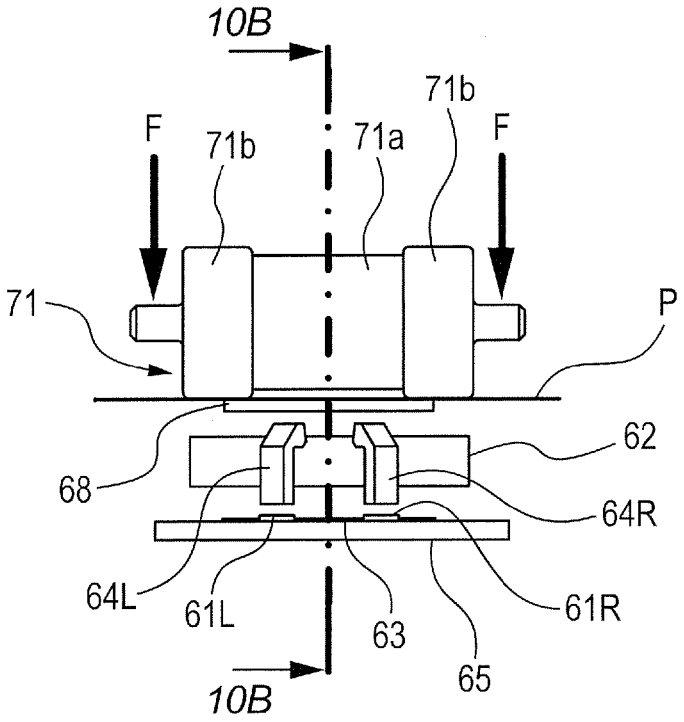
FIG. 10A is an explanatory front view illustrating a structure of a main part of the recording material determining device according to the first embodiment.
Figure 10B:
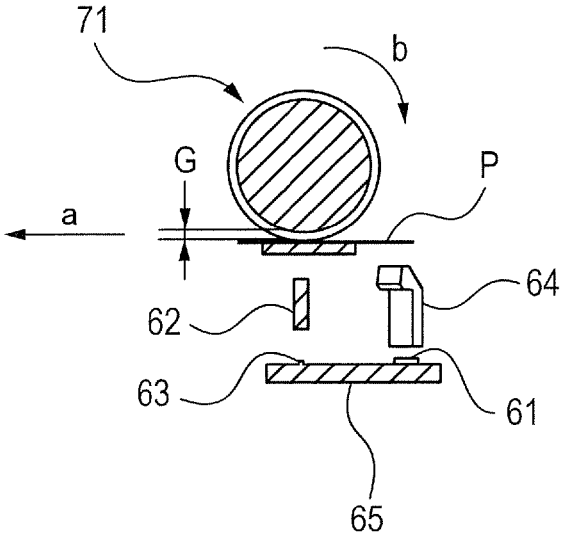
FIG. 10B is an explanatory sectional view illustrating the structure of the main part of the recording material determining device according to the first embodiment.

FIG. 9B illustrates a state in which the recording material P is nipped and conveyed between the roller 71 and the cover member 68, with the pressing force F being applied to the roller 71 to urge a load against the recording material P. FIGS. 10A and 10B illustrate a state in which only the optical system and the roller 71 are provided. As illustrated in FIG. 10A, the recording material P is nipped between and brought into contact with the cover member 68 and the projecting portions 71*b* serving as the contact regions which are provided on both sides of the cylindrical portion of the roller 71.

The recess portion 71*a* serving as the non-contact region of the roller 71 does not nip or come into contact with the recording material P. As illustrated in FIG. 10B, a predetermined gap G exists between an outer peripheral surface of the recess portion 71*a* serving as the non-contact region of the roller 71 and the surface of the cover member 68.

Figure 11:
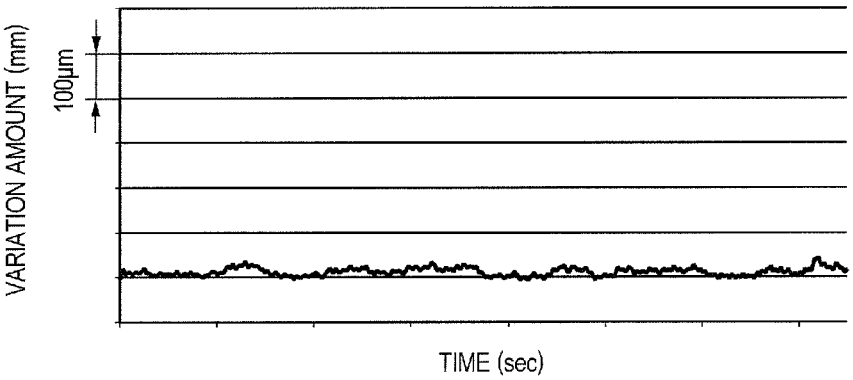
FIG. 11 illustrates a variation amount of the recording material when the recording material is conveyed in the recording material determining device according to the first embodiment.

FIG. 11 shows the variation amount of the surface of the recording material P in this embodiment. In FIG. 11, the horizontal axis indicates time (sec) while the vertical axis indicates variation amount (displacement). Further, the vertical axis is marked in 100 μm increments.

By providing the recess portion 71*a* serving as the non-contact region of the roller 71, the pressing and restraining force for the recording material P is reduced. This allows variations of the surface of the recording material P to some more extent compared with the variation amount of the surface of the recording material P in the comparative example shown in FIG. 7. However, as shown in FIG. 11, also in this embodiment, the variation amount of 100 μm or less is realized, which is allowed by the depth of the optical system. It is found from this fact that the recording material determining device 50 according to this embodiment has an accuracy which is high enough to determine the type of the recording material P through observation of the surface property of the recording material P.

Figure 12A:
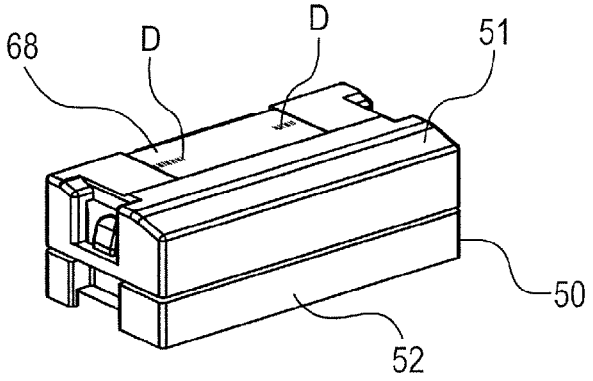
FIG. 12A is a perspective view illustrating a state in which regions of the light transmissive member of the recording material determining device according to the first embodiment, which are located outside image regions used for determining the recording material, are abraded.
Figure 12B:
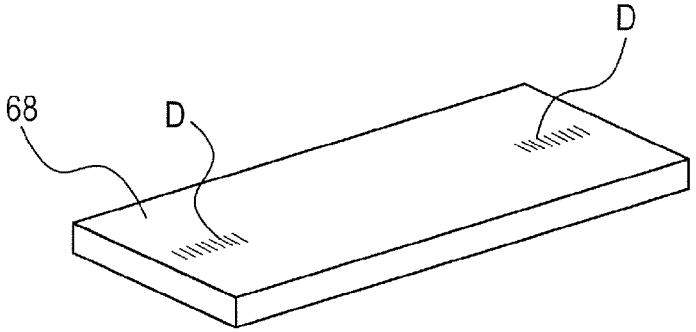
FIG. 12B is a perspective view illustrating the state in which the regions of the light transmissive member of the recording material determining device according to the first embodiment, which are located outside the image regions used for determining the recording material, are abraded.
Figure 12C:
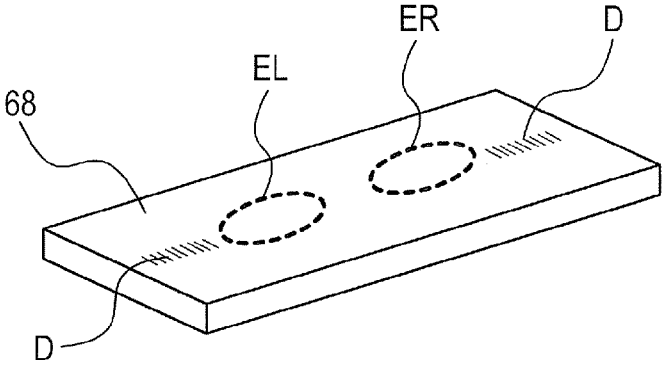
FIG. 12C is a perspective view illustrating the state in which the regions of the light transmissive member of the recording material determining device according to the first embodiment, which are located outside the image regions used for determining the recording material, are abraded.

FIGS. 12A, 12B, and 12C illustrate a state of the surface of the cover member 68 when a large number of the recording materials P of various types are nipped and conveyed using the roller 71 which has the recess portion 71*a* as in this embodiment. FIG. 12A is a perspective view illustrating an overview of the entire recording material determining device 50. FIG. 12B is an enlarged perspective view illustrating only the cover member 68. In FIG. 12C, the effective radiation regions ER and EL which are portions illustrated in FIG. 4B corresponding to the image used for determining the recording material P are indicated by broken lines.

With regard to the direction of the X axis illustrated in FIG. 4B, in this embodiment, as illustrated in FIGS. 12A, 12B, and 12C, the abrasion D by the recording material P was not observed at a location on the surface of the cover member 68 which corresponds to the recess portion 71*a* of the roller 71 including the entire effective radiation regions ER and EL.

At locations corresponding to portions other than the recess portion 71*a* of the roller 71 at which the recording material P is pressed, the abrasion D similar to that in the comparative example was caused. In this way, even after a large number of the recording materials P are conveyed, the abrasion D is not caused at the location on the surface of the cover member 68 which corresponds to the recess portion 71*a* of the roller 71, and the surface of the cover member 68 does not change. The state of the surface of the recording material P which is observed with light radiated thereto is maintained at the initial state. Therefore, in this embodiment, a satisfactory state for observation is maintained before and after a large number of the recording materials P are conveyed.

This means that the accuracy of determining the recording material P in the initial state can be maintained for a long period of time. A structure was realized, which minimized variations of the surface of the recording material P and still did not reduce the accuracy of the determination due to irregular reflection components that were caused by the abrasion D on the surface of the cover member 68. According to the above-mentioned structure, flaps of the recording material are suppressed by the contact regions which are brought into contact with the recording material, and at the same time, the non-contact region, which is not brought into contact with the entire portion corresponding to the image used for determining the recording material, can suppress damage to the light transmissive member.

Light is radiated from two directions to the moving recording material P, and the property of the surface of the recording material P is observed to determine the type of the recording material P. In this case, in order to hold the variations of the surface of the recording material P within an optical guaranteed range of measurement, the roller 71 for pressing the recording material P against the observation surface is used. By providing the recess portion 71*a* in a part of the roller 71, even if a large number of the recording materials P of various types are conveyed, the performance of observing the property of the surface of the recording material P can be maintained for a long period of time. This enables assurance of the accuracy of determining the recording material P. Further, the recording material determining device 50 of this embodiment is small in size and can be formed at a low cost, and a device having a high accuracy of determining the recording material P can be realized.

This embodiment is described using surface mounted LEDs as the light sources 61. However, insofar as light can be radiated to the recording material P from two directions with respect to the conveyance direction under predetermined conditions, shell-type LEDs may be adopted, and other illumination units may also be used.

Illumination light from the light sources 61 was guided to the surface of the recording material P using light guiding members such as the deflectors 64. However, it is not necessary to use the light guiding members, and optical paths may be set and light guide paths using reflectors or the like may be set.

(Second Embodiment)

Next, a structure of an image forming apparatus including a recording material determining device (recording material image capture device) according to a second embodiment of the present invention is described with reference to FIGS. 13A and 13B and FIG. 14. The same reference symbols are used to indicate members similar to those in the first embodiment and description thereof is omitted.

In this embodiment, the two light sources 61R and 61L for radiating light to the recording material P from different directions are provided as the light radiating unit. A roller 72 which serves both as a pressing member and a rotating member includes recess portions 72*a*1 and 72*a*2 serving as two non-contact regions corresponding to portions of the recording material P to which light is radiated from the two light sources 61R and 61L, respectively.

A projecting portion 72*b*1 serving as a contact region is provided between the recess portions 72*a*1 and 72*a*2 serving as the non-contact regions in a direction orthogonal to the conveyance direction of the recording material P (axial direction of the roller 72), and further, projecting portions 72*b*2 and 72*b*3 serving as contact regions are provided on both sides of the recess portions 72*a*1 and 72*a*2, respectively.

Figure 13A:
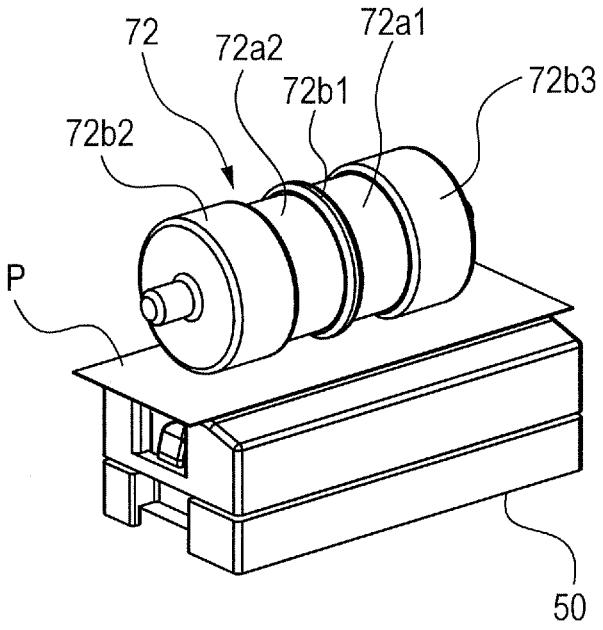
FIG. 13A is an explanatory perspective view illustrating a structure of a recording material determining device according to a second embodiment of the present invention.
Figure 13B:
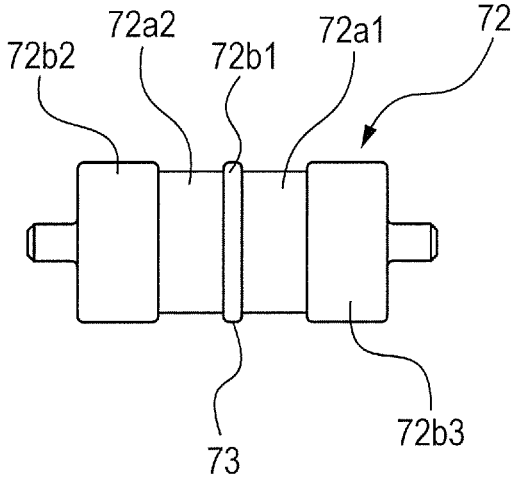
FIG. 13B is an explanatory front view illustrating a structure of a pressing member according to the second embodiment.

FIG. 13A is an explanatory perspective view illustrating the roller 72 which serves both as a rotating member and a pressing member for pressing the recording material P against the cover member 68 of the recording material determining device 50. In this embodiment, the projecting portion 72*b*1 serving as the contact region which is brought into contact with the recording material P is further added between the recess portions 72*a*1 and 72*a*2 serving as the non-contact regions which are provided on the roller 72.

Various types of the recording material P are used, and the main body of the image forming apparatus 3 is used in various environments. It cannot be completely ensured that the recording material P is conveyed without fail and with stability in the range of the recess portion 71*a* of the roller 71 of the above-mentioned first embodiment. In the recording material determining device 50, the effective radiation regions ER and EL for determining the recording material P are set on both sides within the recess portion 71*a* provided on the cylindrical roller 71.

Conversely, the location between the set effective radiation regions ER and EL is not involved in the measurement for determining the recording material P. By additionally providing the projecting portion 72*b*1 at the location which is not involved in the detection and determination of the recording material P and providing pressing portions for pressing the recording material P on both sides of the recess portions 72*a*1 and 72*a*2, respectively, and at the portion therebetween, conveyance of the recording material P can be realized with stability.

Figure 14:
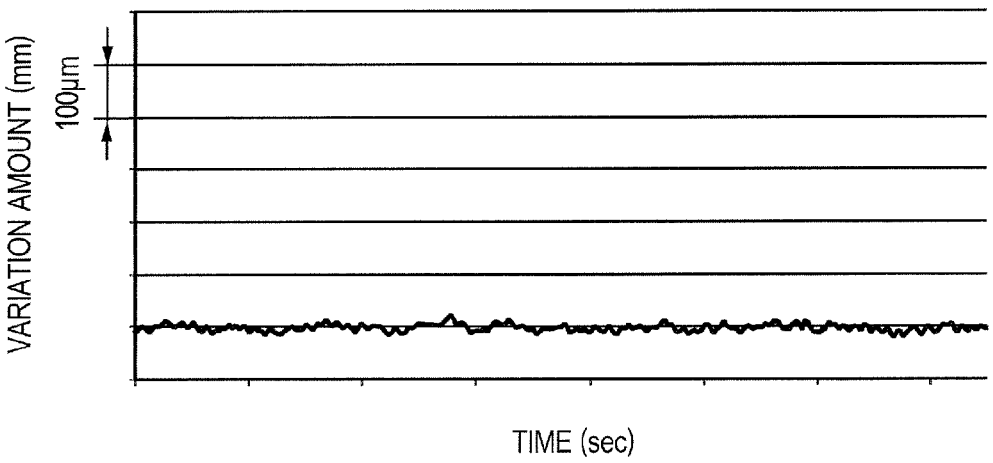
FIG. 14 shows a variation amount of the recording material when the recording material is conveyed in the recording material determining device according to the second embodiment.

FIG. 14 illustrates exemplary measurements of the variation amount of the surface of the recording material P when the recording material P is conveyed according to this embodiment. In FIG. 14, the horizontal axis indicates time (sec) while the vertical axis indicates variation amount (mm). Further, the vertical axis is marked in 100 μm increments.

As shown in FIG. 14, also in this embodiment, although the variation is caused to some more extent compared with that in the comparative example illustrated in FIG. 7, the variation amount of 100 μm or less is realized, which is sufficiently allowed by the depth of the optical system. It is found from this fact that the state is satisfactory for the observation of the surface property of the recording material P and the determination of the type of the recording material P.

In this embodiment, by additionally providing the projecting portion 72*b*1 serving as the pressing portion for pressing the recording material P to the maximum extent insofar as the measurement is not affected, the variation amount when the recording material P is conveyed can be further suppressed. The image forming apparatus 3 is robust against change in measurement conditions due to external factors such as the recording material P of various types and the usage environment of the image forming apparatus 3, and, as a result, the accuracy of determining the recording material can be stabilized. The structure is otherwise similar to that of the above-mentioned first embodiment, and similar effects can be obtained. According to the above-mentioned structure, flaps of the recording material are suppressed by the contact regions in contact with the recording material, and at the same time, the non-contact regions, which are not brought into contact with the entire portions corresponding to the image used for determining the recording material, can suppress damage to the light transmissive member.

(Third Embodiment)

Next, a structure of an image forming apparatus including a recording material determining device (recording material image capture device) according to a third embodiment of the present invention is described with reference to FIGS. 15A and 15B. The same reference symbols are used to indicate members similar to those in the above-mentioned embodiments and description thereof is omitted.

Figure 15A:
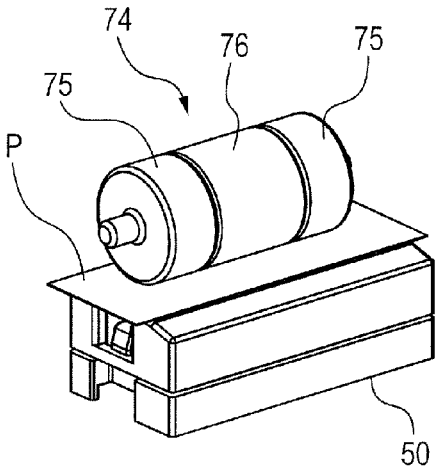
FIG. 15A is an explanatory perspective view illustrating a structure of a recording material determining device according to a third embodiment of the present invention.
Figure 15B:
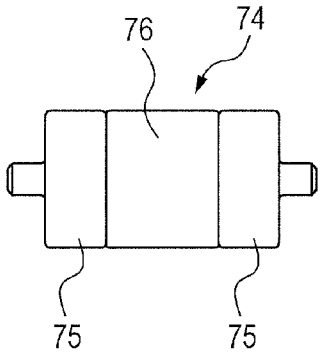
FIG. 15B is an explanatory front view illustrating a structure of a pressing member according to the third embodiment.

FIG. 15A illustrates a roller 74 which is provided so as to be opposed to the cover member 68 of the recording material determining device 50 and serves as a rotating member and a pressing member for pressing the recording material P toward the cover member 68.

The roller 74 of this embodiment has ends (hard portions) 75 formed of hard members having a Rockwell hardness of 80 to 120 serving as contact regions which are brought into linear contact with the recording material P. The roller 74 further has a center portion (soft portion) 76 formed of a soft member having an Asker C hardness of 10 to 30 or a rubber hardness of 10 to 30 serving as a contact region which is brought into elastic contact with the recording material P.

In this embodiment, a new pressing member (center portion 76) is added to the recess portion 71*a* of the roller 71 of the first embodiment illustrated in FIGS. 9A and 9B.

Various types of the recording material P are used, and the main body of the image forming apparatus 3 is used in various environments. Thus, it cannot be completely ensured that the recording material P is conveyed without fail and with stability in the range of the recess portion 71*a* of the roller 71 of the above-mentioned first embodiment. Providing a unit for actively pressing and urging the cover member 68 may induce damage to the surface of the cover member 68.

As a measure against that, in the above-mentioned first embodiment, the recess portion 71*a* is provided in a part of the outer peripheral surface of the roller 71 as a pressing member. In this embodiment, the structure of the cylindrical roller 74 is divided into two components, that is, the ends 75 and the center portion 76.

At portions where damage to the cover member 68 is allowable (portions which are brought into contact with portions which do not correspond to the image used for determining the recording material), the ends 75 are formed of a relatively hard material typified by resin members as the body of the roller 74, and actively press the recording material P to suppress the variation amount of the recording material P.

On the other hand, at the center portion 76 where damage to the cover member 68 is not desired (portion which is brought into contact with a portion corresponding to the image used for determining the recording material), the center portion 76 is formed of a relatively soft material such as so-called rubber or sponge. Such a soft member elastically presses and supports the recording material P to some extent from behind, but does not actively urge and pressurize the recording material P. This suppresses the variation amount of the surface of the recording material P, and at the same time, suppresses damage to the cover member 68.

The center portion 76 formed of the soft member is not a complete space, and thus, slight pressing force is generated. If the abrasion D of the cover member 68 is allowable within the range of the number of the conveyed recording materials P which is set taking the life of the image forming apparatus 3 into consideration, this embodiment can be adopted.

In this embodiment, by appropriately changing the hardness of the pressing portions which press the recording material P and setting the center portion 76 as a separate soft member, both suppression of the variation amount of the recording material P when the recording material P is conveyed and suppression of damage to the cover member 68 can be accomplished. That is, in this embodiment, in the pressing member, the hardness of the portion which is brought into contact with a portion corresponding to the image used for determining the recording material (soft portion) is set smaller (softer) than the hardness of the portions which are brought into contact with portions which do not correspond to the image used for determining the recording material (hard portions). In this way, the variation amount of the recording material P when the recording material P is conveyed is suppressed, and at the same time, damage to the cover member 68 is suppressed. The structure is otherwise similar to those of the above-mentioned embodiments, and similar effects can be obtained. According to the above-mentioned structure, flaps of the recording material are suppressed by the contact regions which are brought into contact with the recording material, and at the same time, the soft portion which is brought into contact with the portion corresponding to the image used for determining the recording material can suppress damage to the light transmissive member.

(Fourth Embodiment)

Next, a structure of an image forming apparatus including a recording material determining device (recording material image capture device) according to a fourth embodiment of the present invention is described with reference to FIGS. 16 to 18B. The same reference symbols are used to indicate members similar to those in the above-mentioned embodiments and description thereof is omitted.

Figure 16:
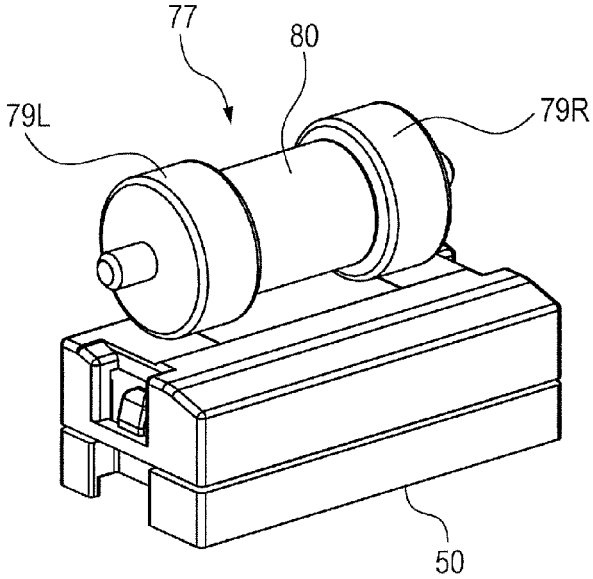
FIG. 16 is an explanatory perspective view illustrating a structure of a recording material determining device according to a fourth embodiment of the present invention.

FIG. 16 illustrates a roller 77 which serves as a rotating member and a pressing member for pressing the recording material P against the cover member 68 of the recording material determining device 50. The roller 77 includes a cylindrical member 80 which is provided so as to be opposed to a non-contact region which is not brought into contact with the entire portion corresponding to the image used for determining the recording material P. The cylindrical member 80 serves as a contact member of the roller 77 which can be brought into contact with a portion corresponding to the image used for determining the recording material P. The cylindrical member 80 is movable independently of the roller 77 in a direction in which the roller 77 presses the recording material P toward the cover member 68.

In this embodiment, the structure of the roller 71 including the recess portion 71*a* of the first embodiment illustrated in FIGS. 9A and 9B is changed, and the cylindrical member 80 which can restrain the recording material P is added to the recess portion 71*a*.

Various types of the recording material P are used, and the main body of the image forming apparatus 3 is used in various environments. Thus, it cannot be completely ensured that the recording material P is conveyed without fail and with stability in the range of the recess portion 71*a* of the roller 71 of the first embodiment illustrated in FIGS. 9A and 9B. Providing an urging unit for actively pressing the cover member 68 may induce damage to the surface of the cover member 68.

Figure 17A:
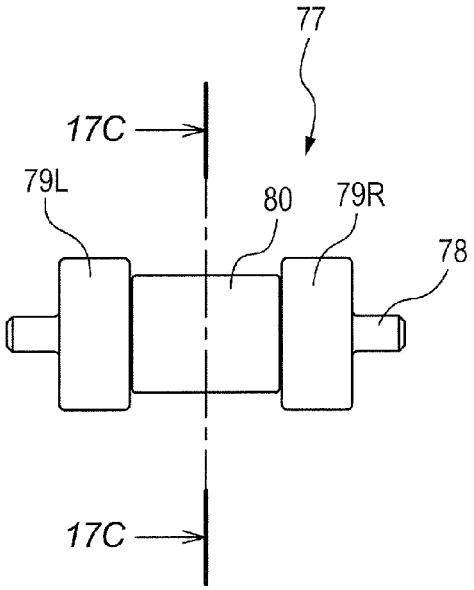
FIG. 17A is an explanatory front view illustrating a structure of a pressing member according to the fourth embodiment.
Figure 17B:
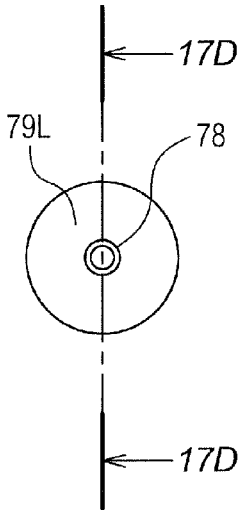
FIG. 17B is an explanatory side view illustrating the structure of the pressing member according to the fourth embodiment.
Figure 17C:
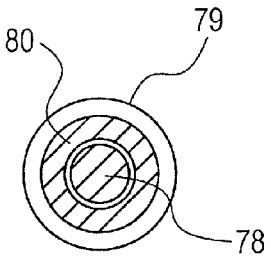
FIG. 17C is a sectional view taken along the line 17C-17C of FIG. 17A.
Figure 17D:
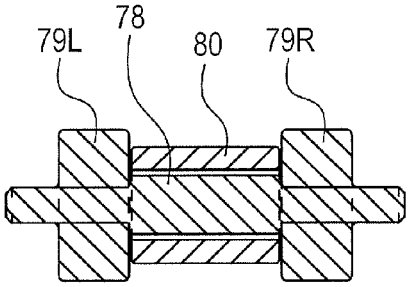
FIG. 17D is a sectional view taken along the line 17D-17D of FIG. 17B.

Therefore, in this embodiment, another exemplary structure of the cylindrical roller 77 is described. FIG. 17A is a front view illustrating the entire structure of the roller 77. FIG. 17B is a side view of the roller 77. FIG. 17C is a sectional view taken along the line 17C-17C of FIG. 17A, and FIG. 17D is a sectional view taken along the line 17D-17D of FIG. 17B.

As illustrated in FIGS. 17A to 17D, a body portion of the roller 77 includes a shaft member 78 and pressing portions 79R and 79L for pressing the recording material P. The cylindrical member 80 which can be brought into contact with the recording material P serving as a member for restraining the recording material P is rotatably mounted by inserting the shaft member 78 in an axial direction of the shaft member 78 between the pressing portions 79R and 79L for pressing the recording material P. A predetermined gap G exists between the cylindrical member 80 and the shaft member 78, and the cylindrical member 80 is rotatably held with respect to the shaft member 78.

Figure 18A:
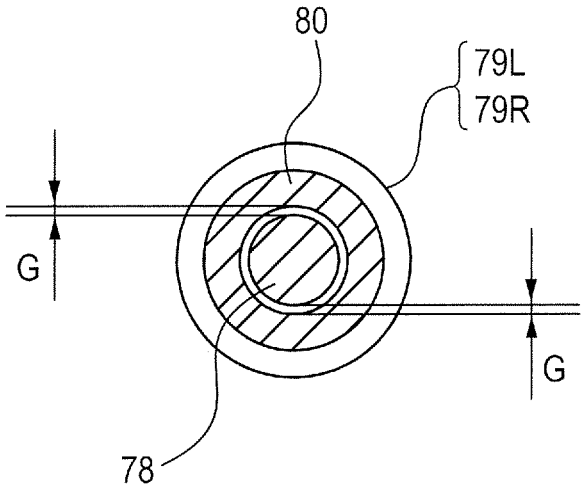
FIG. 18A is an explanatory sectional view illustrating a state in which a contact member according to the fourth embodiment moves in a direction in which the pressing member presses the recording material toward the light transmissive member.

The cylindrical member 80 is movable independently of the body portion of the roller 77 in a direction in which the body portion of the roller 77 presses the recording material P toward the cover member 68. FIG. 18A illustrates a state in which the axial center of the shaft member 78 and the axial center of the cylindrical member 80 are coincident with each other and the gap G is formed between an outer peripheral surface of the shaft member 78 and an inner peripheral surface of the cylindrical member 80.

Figure 18B:
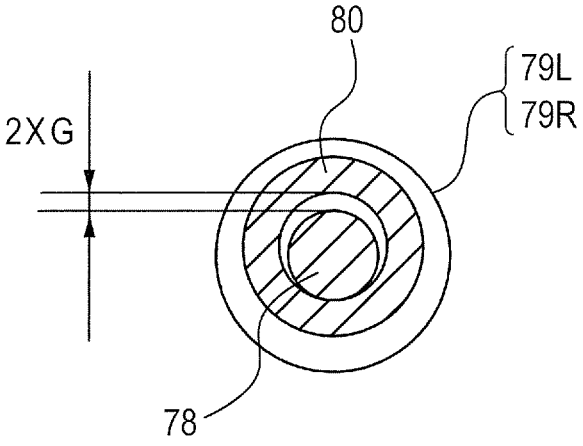
FIG. 18B is an explanatory sectional view illustrating the state in which the contact member according to the fourth embodiment moves in the direction in which the pressing member presses the recording material toward the light transmissive member.

FIG. 18A illustrates a state in which the gap G is uniformly formed around the shaft member 78. Actually, under the influence of gravity and the like, the cylindrical member 80 is in a state of being urged in a given direction. When the recording material P enters a space between the roller 77 and the cover member 68, as illustrated in FIG. 18B, the cylindrical member 80 rotates and conveys the recording material P, and is brought into contact with the recording material P. The cylindrical member 80 moves in a direction opposite to the direction in which the body portion of the roller 77 presses the recording material P toward the cover member 68 (upward in FIG. 18B).

Now, the gap G on the lower side is lost and the gap on the upper side is "2×G" at the maximum as illustrated in FIG. 18B. Insofar as the variation amount of the surface of the recording material P when the recording material P is conveyed is small, the amount of deformation of the recording material P when the recording material P is conveyed is relatively mildly restrained due to the influence of the self weight of the cylindrical member 80 and the like. When the recording material is deformed to the extent that the gap G between the cylindrical member 80 and the shaft member 78 is reduced to the maximum, the shaft member 78 and the cylindrical member 80 which have higher stiffness than that of the recording material P can realize a state in which no further deformation is allowed.

When the recording material P is normally conveyed, the cylindrical member 80 rotates and, at the same time, moves by about a variation amount which is equal to or smaller than the size of the gap G, to thereby maintain a state in which the variation amount of the recording material P when the recording material P is conveyed is relatively mildly restrained. In this case, the force of pressing the surface of the cover member 68 by the recording material P is small, and thus, the abrasion D is not caused in the effective radiation regions ER and EL in the cover member 68.

In this embodiment, by adding, to the roller 77, the cylindrical member 80 for mildly restraining the variation amount of the recording material P, both suppression of the variation amount of the recording material P when the recording material P is conveyed and suppression of damage to the cover member 68 can be achieved. The structure is otherwise similar to those of the above-mentioned embodiments, and similar effects can be obtained. According to the above-mentioned structure, flaps of the recording material are suppressed by the contact regions which are brought into contact with the recording material, and at the same time, the cylindrical member which is brought into contact with the portion corresponding to the image used for determining the recording material can suppress damage to the light transmissive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-270253, filed Dec. 11, 2012, which is hereby incorporated by reference herein in its entirety.

What is claimed is:

1. A recording material image capture device, comprising:

a light radiating unit radiating light to a recording material;

an image capture unit receiving the light which is radiated from the light radiating unit and is reflected on a surface of the recording material;

a light transmissive member provided between the image capture unit and the recording material to which the light is radiated from the light radiating unit so that the light reflected on the surface of the recording material passes through the light transmissive member;

an opposing member provided so as to be opposed to the light transmissive member, wherein nipping the recording material by the light transmissive member and the opposing member causes the opposing member to have a contact region which is brought into contact with the recording material and a non-contact region which is not brought into contact with the recording material, wherein the non-contact region extends over an entire region corresponding to an image used for determining the recording material; and an output portion outputting, based on an image captured by the image capture unit, a value related to the recording material to which the light is radiated from the light radiating unit.

2. A recording material image capture device according to claim 1, wherein the contact region is provided on both sides of the non-contact region in a direction orthogonal to a conveyance direction of the recording material.

3. A recording material image capture device according to claim 1, wherein:

the light radiating unit has two light sources radiating the light to the recording material from different directions; and the non-contact region of the opposing member includes two non-contact regions corresponding to portions of the recording material to which the light is respectively radiated from the two light sources.

4. A recording material image capture device according to claim 1, further comprising a contact member provided so as to be opposed to the non-contact region, the contact member being capable of contacting with a portion of the recording material corresponding to the image used for determining the recording material, wherein the contact member is movable independently of the opposing member in a direction in which the opposing member presses the recording material toward the light transmissive member.

5. A recording material image capture device according to claim 1, wherein the opposing member comprises a roller rotating along with movement of the recording material which is conveyed on the light transmissive member.

6. An image forming apparatus, comprising:

a light radiating unit radiating light to a recording material;

an image capture unit receiving the light which is radiated from the light radiating unit and is reflected on a surface of the recording material;

a light transmissive member provided between the image capture unit and the recording material to which the light is radiated from the light radiating unit so that the light reflected on the surface of the recording material passes through the light transmissive member;

an opposing member provided so as to be opposed to the light transmissive member, wherein nipping the recording material by the light transmissive member and the opposing member causes the opposing member to have a contact region which is brought into contact with the recording material and a non-contact region which is not brought into contact with the recording material, wherein the non-contact region extends over an entire region corresponding to an image used for determining the recording material;

an output portion outputting, based on an image captured by the image capture unit, a value related to the recording material to which the light is radiated from the light radiating unit; and an image forming unit forming a toner image on the recording material, the image forming unit determining image forming conditions based on the output from the output portion.

7. An image forming apparatus according to claim 6, wherein:

the image forming unit has an image bearing member on which the toner image is formed, and a transfer unit transferring the toner image formed on the image bearing member onto the recording material; and the image forming unit determines transfer conditions of the transfer unit as the image forming conditions based on the output from the output portion.

8. An image forming apparatus according to claim 6, wherein:

the image forming unit has a fixing unit heating, pressurizing and fixing the toner image formed on the recording material; and the image forming unit determines fixing conditions of the fixing unit as the image forming conditions based on the output from the output portion.

9. An image forming apparatus according to claim 6, wherein the opposing member comprises a roller rotating along with movement of the recording material which is conveyed on the light transmissive member.

10. A recording material image capture device, comprising:

a light radiating unit radiating light to a recording material;

an image capture unit receiving the light which is radiated from the light radiating unit and is reflected on a surface of the recording material;

a light transmissive member provided between the image capture unit and the recording material to which the light is radiated from the light radiating unit so that the light reflected on the surface of the recording material passes through the light transmissive member;

an opposing member provided so as to be opposed to the light transmissive member, the opposing member having a hard portion being brought into contact with the recording material and a soft portion being brought into elastic contact with the recording material, wherein the soft portion extends over an entire region corresponding to an image used for determining the recording material; and an output portion outputting, based on an image captured by the image capture unit, a value related to the recording material to which the light is radiated from the light radiating unit.

11. A recording material image capture device according to claim 10, wherein:

the hard portion has a Rockwell hardness of 80 or more and 120 or less; and the soft portion has one of an Asker C hardness of 10 or more and 30 or less, and a rubber hardness of 10 or more and 30 or less.

12. A recording material image capture device according to claim 10, wherein the soft portion is movable independently of the hard portion in a direction in which the opposing member presses the recording material toward the light transmissive member.

13. A recording material image capture device according to claim 10, wherein the opposing member comprises a roller rotating along with movement of the recording material which is conveyed on the light transmissive member.

14. An image forming apparatus, comprising:

a light radiating unit radiating light to a recording material;

an image capture unit receiving the light which is radiated from the light radiating unit and is reflected on a surface of the recording material;

a light transmissive member provided between the image capture unit and the recording material to which the light is radiated from the light radiating unit so that the light reflected on the surface of the recording material passes through the light transmissive member;

an opposing member provided so as to be opposed to the light transmissive member, the opposing member having a hard portion being brought into contact with the recording material and a soft portion being brought into elastic contact with the recording material, wherein the soft portion extends over an entire region corresponding to an image used for determining the recording material;

an output portion outputting, based on an image captured by the image capture unit, a value related to the recording material to which the light is radiated from the light radiating unit; and an image forming unit forming a toner image on the recording material, the image forming unit determining image forming conditions based on the output from the output portion.

15. An image forming apparatus according to claim 14, wherein:

the image forming unit has an image bearing member on which the toner image is formed, and a transfer unit transferring the toner image formed on the image bearing member onto the recording material; and the image forming unit determines transfer conditions of the transfer unit as the image forming conditions based on the output from the output portion.

16. An image forming apparatus according to claim 14, wherein:

the image forming unit has a fixing unit heating, pressurizing and fixing the toner image formed on the recording material; and the image forming unit determines fixing conditions of the fixing unit as the image forming conditions based on the output from the output portion.

17. An image forming apparatus according to claim 14, wherein the opposing member comprises a roller rotating along with movement of the recording material which is conveyed on the light transmissive member.

18. A recording material image capture device, comprising:

a light radiating unit radiating light to a recording material;

an image capture unit receiving the light which is radiated from the light radiating unit and is reflected on a surface of the recording material;

a light transmissive member provided between the image capture unit and the recording material to which the light is radiated from the light radiating unit so that the light reflected on the surface of the recording material passes through the light transmissive member;

an opposing member provided so as to be opposed to the light transmissive member, wherein nipping the recording material by the light transmissive member and the opposing member causes the opposing member to have a contact region which is brought into contact with the recording material and a non-contact region which is not brought into contact with the recording material, wherein the non-contact region extends over an entire region where the light radiating unit radiates the light; and an output portion outputting, based on an image captured by the image capture unit, a value related to the recording material to which the light is radiated from the light radiating unit.

19. A recording material image capture device, comprising:

a light radiating unit radiating light to a recording material;

an image capture unit receiving the light which is radiated from the light radiating unit and is reflected on a surface of the recording material;

a light transmissive member provided between the image capture unit and the recording material to which the light is radiated from the light radiating unit so that the light reflected on the surface of the recording material passes through the light transmissive member;

an opposing member provided so as to be opposed to the light transmissive member, the opposing member having a hard portion being brought into contact with the recording material and a soft portion being brought into elastic contact with the recording material, wherein the soft portion extends over an entire region where the light radiating unit radiates the light; and an output portion outputting, based on an image captured by the image capture unit, a value related to the recording material to which the light is radiated from the light radiating unit.

* * * * *